US005702574A

United States Patent [19]

Foster et al.

[11] Patent Number: 5,702,574

[45] Date of Patent: Dec. 30, 1997

[54] JIG FOR COATING ROTOR BLADES

[75] Inventors: John Foster, Avon; Alan Taylor, Somerset; Martin Patrick Chatterley, Avon, all of England

[73] Assignee: Praxair S.T. Technology, Inc., Danbury, Conn.

[21] Appl. No.: 505,322

[22] PCT Filed: Dec. 21, 1994

[86] PCT No.: PCT/GB94/02777

§ 371 Date: May 3, 1996

§ 102(e) Date: May 3, 1996

[87] PCT Pub. No.: WO95/17535

PCT Pub. Date: Jun. 29, 1995

[30] Foreign Application Priority Data

Dec. 21, 1993 [GB] United Kingdom ..... 9326082

[51] Int. Cl.[6] ..... C25D 5/02; C25D 17/06

[52] U.S. Cl. ..... 204/224 R; 118/500; 204/297 R; 205/110; 205/128; 205/136

[58] Field of Search ..... 204/224 R, 297 R, 204/297 W; 205/109, 110, 128, 136, 145; 118/213, 301, 500, 503, 504, 505; 427/282

[56] References Cited

U.S. PATENT DOCUMENTS

| | | | |
|---|---|---|---|
| 4,088,560 | 5/1978 | Swinehart et al. | 204/297 |
| 4,151,063 | 4/1979 | Nelson | 204/297 |
| 4,808,275 | 2/1989 | Ohzora et al. | 204/16 |
| 5,076,897 | 12/1991 | Wride et al. | 205/110 |
| 5,486,281 | 1/1996 | Gruver et al. | 205/110 |

FOREIGN PATENT DOCUMENTS

| | | |
|---|---|---|
| 2006270 | 5/1979 | United Kingdom . |
| 2127855 | 4/1984 | United Kingdom . |
| 2162200 | 1/1986 | United Kingdom . |
| 2167446 | 5/1986 | United Kingdom . |
| 2241506 | 9/1991 | United Kingdom . |
| 94/19583 | 9/1994 | WIPO . |

*Primary Examiner*—Kathryn L. Gorgos
*Assistant Examiner*—William T. Leader
*Attorney, Agent, or Firm*—Douglas E. Denninger

[57] ABSTRACT

A method of and apparatus for producing abrasive tips on compressor or turbine rotor blades by electrolytic or electroless deposition in which the blades are mounted in a hollow jig with the tips of the blades extending through sealed openings in the jig and abrasive tips are formed on the tips. The parts of the blades within the hollow jig are isolated from the electrolyte without the need for wax masking. Preferably the jig is cylindrical with the blades extending radially through at least one circumferential row of apertures. The jig may comprise two end discs and at least one ring in which a circumferential row of apertures is formed. The ring is positioned between the end discs and means are provided for securing the discs and ring together.

6 Claims, 6 Drawing Sheets

JIG FOR COATING ROTOR BLADES

This is a national stage application of PCT/GB/02777, filed on Dec. 21, 1994.

This invention relates to blades for turbines and compressors and in particular relates to the production of blade tip seals.

It is known to provide at the tip of a gas turbine blade a tip portion comprising abrasive particles which are embedded in a matrix, the tip being intended to run against the surface of a shroud of a material which is softer than the abrasive particles. By this means, it is possible to produce, by the abrasive action of the particles on the shroud, a gap between the tip and the shroud which is very small, thus minimising gas losses. In one particular example where this technique is used, the matrix comprises a major part of cobalt and minor parts of chromium, tantalum and alumina while the lining material of the shroud comprises a major part of cobalt with minor parts of nickel, chromium and aluminium and a small quantity of yttrium. Various methods for producing such tips have been proposed. In one example, detonation spray coating of the matrix is used. In another example there is first produced an inner tip portion of mainly nickel and cobalt with additional ingredients by casting as a single crystal and the inner tip portion is, after shaping, diffusion bonded to the tip of the blade body. The abrasive portion of the tip is then formed on the inner tip portion by electrodeposition of alternating layers of chromium and nickel about the abrasive particles. The outer tip portion can then be aluminised to produce a matrix alloy of NiCrAl.

There has been described in GB-A-2241506 a method of producing a gas turbine blade having an abrasive tip which comprises producing a binding coat on the tip of the blade body by electrodeposition, the binding coat comprising MCrAlY where M is one or more of iron, nickel and cobalt, anchoring to the binding coat coarse particles of an abrasive material by composite electrodeposition from a bath of plating solution having the abrasive particles suspended therein, and then plating an infill around the abrasive particles. It has been found that this method, all stages of which are of a metal plating nature and are therefore relatively inexpensive and readily controllable, produces a very effective abrasive blade tip.

There is also described in WO 94/19583, published 1 Sep. 1994, a process in which turbine rotor blades are assembled on a compressor or rotor disc and abrasive tips are produced on the tips of the assembled blades by electrodeposition or by electroless deposition.

Production of the tips on the assembled blades has several advantages, the chief of which is that it is possible to carry out various production steps on the assembled disc without subsequent disassembly. The previous practise was for the blades to be assembled on the disc and for the tips of the blades to be machined to produce a properly balanced disc. The blades were then marked, disassembled from the disc, individually mounted on a jig, tipped, removed from the jig and then reassembled on the disc in the same order and positions that they previously occupied. By proceeding in accordance with the invention of WO 94/19583, one of the two assembly operations, jigging and dejigging, the marking and the disassembly are avoided and unbalancing due to the blades being re-assembled in slightly different attitudes or positions from those previously adopted is obviated.

With the processes referred to above which involve electrodeposition, it is necessary, in order to limit the deposition to the tip areas of the blades, to wax mask all other areas of the blades and of the jig by which the blades are supported during the deposition process. Masking is achieved by grit blasting to provide a key for the masking wax where the surface of the blades will not be damaged by such blasting, then inserting an assembly comprising a support and the blades mounted thereon into a wax bath to mask all surfaces of the support and blades and then removing the wax from the tips of the blades. After the tips have been produced, the wax has to be removed from the blades and the support. These procedures themselves are time-consuming and expensive and it is necessary to add to this expense the cost of the wax and the cost of properly disposing of the stripped wax without causing pollution.

According to the present invention, the disadvantages of wax masking are reduced or avoided by mounting a plurality of blades in a hollow jig with the tips of the blades extending through sealed openings in the jig and forming abrasive tips on the blade tips at least partially by electrodeposition.

The process according to the invention is particularly suited to blade tipping using the methods described in GB-A-2241506 in which a binding coat is produced on the tip of each blade by electrodeposition, coarse particles of an abrasive material are anchored to the binding coat by composite electrodeposition of the particles and an anchoring coat and then plating an infill around the particles. The binding coat may comprise MCrAlY where M is one or more of iron, nickel and cobalt. The anchoring coat may be of cobalt or nickel or MCrAlY as defined above and the infill may also be MCrAlY and defined above.

The blades may be tipped while assembled on a compressor or rotor disc, which term is intended to cover bosses, rings and similar blade mounting elements which terms are used for substantially the same structures. Although it is possible to treat the discs individually, further benefits can be obtained by first assembling a plurality of rings together to form a part or a whole turbine or compressor rotor. This again reduces the steps required and helps to maintain balance.

Various particles may be employed. Examples include zirconia, alumina and various nitrides, silicides and borides known from the abrasive art. The preferred abrasive is cubic boron nitride, preferably having a particle size between 125 and 150 μm. It is possible for the infill, or at least the upper or outer portion thereof, to include abrasive particles of a size substantially smaller than the main abrasive particles, for example approximately 20 μm.

The MCrAlY of the binding coat, the anchoring layer where this is MCrAlY, and the infill where this is MCrAlY may have various compositions of which suitable examples are described in British Patent Specification GB-2167446B. The electrodeposition may be effected by various forms of apparatus. However, suitable forms of apparatus are described in British Patent Specification Nos. GB-2182055A and European Patent Specification No. EP-0355051A. These describe apparatus which comprises an electroplating tank which is divided into two zones by a vertical wall extending from close to the bottom of the tank up to just beneath the surface of the solution in the bath. Gas is admitted to one of the zones to induce an upward flow of solution therein, the solution, with particles entrained therein, spilling over the weir formed by the upper edge of the division wall and descending in the second zone in which the article to be coated is located. The latter specification describes rotating the article with a stop-start or quick-slow cycle.

Where the infill is of MCrAlY, that is it consists of particles of CrAlY in a metal matrix, the deposition of the infill is preferably accompanied by vibration of the assembly, preferably in a vertical direction. It is believed that such vibration ensures an even distribution of CrAlY particles, particularly in those regions which are shaded by the overhang of the abrasive particles and which regions might otherwise be depleted of particles. The frequency of the vibration is preferably between 10 Hz and 1 kHz, the particularly preferred figure being about 50 Hz. A peak acceleration of up to 10 g is preferred. It is believed that a particularly good result is achieved by vibrating at two alternating levels, for example a vibration with a peak level of about 2 g alternating with a vibration with a peak level of about 10 g. Preferably, each lower level phase is longer than each higher level phase; thus the lower level phases may be for between 30 seconds and 2 minutes duration with a peak acceleration of about 2 g and the higher level phases may be for about 5 seconds duration with a peak acceleration of about 10 g.

The invention may be carried into practice in various ways but a process of producing a gas turbine blade in accordance with the invention together with apparatus suitable for carrying out the process will now be described by way of example with reference to the accompanying drawings in which:

DETAILED DESCRIPTION OF THE INVENTION

The process to be described is intended to form abrasive tips on the blades of a gas turbine rotor.

Figure 1:
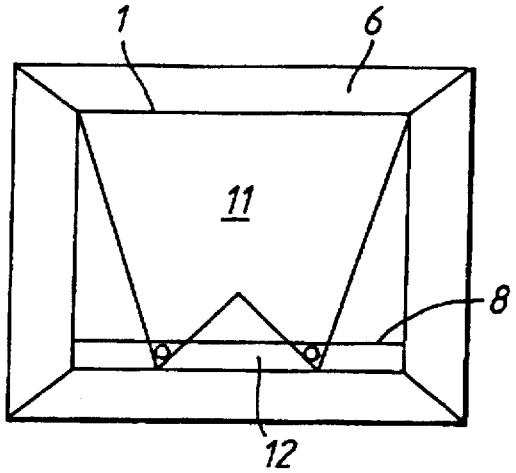
FIG. 1 is a diagrammatic plan view of one of the plating baths used in the process.
Figure 2:
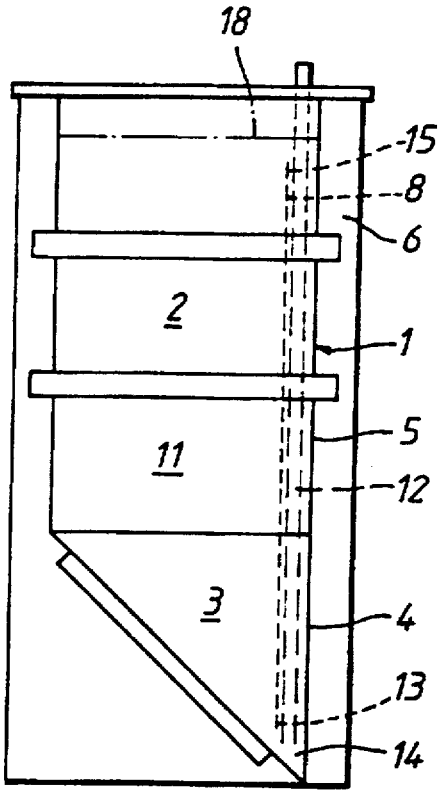
FIG. 2 is a diagrammatic side elevation of the apparatus shown in FIG. 1.
Figure 3:
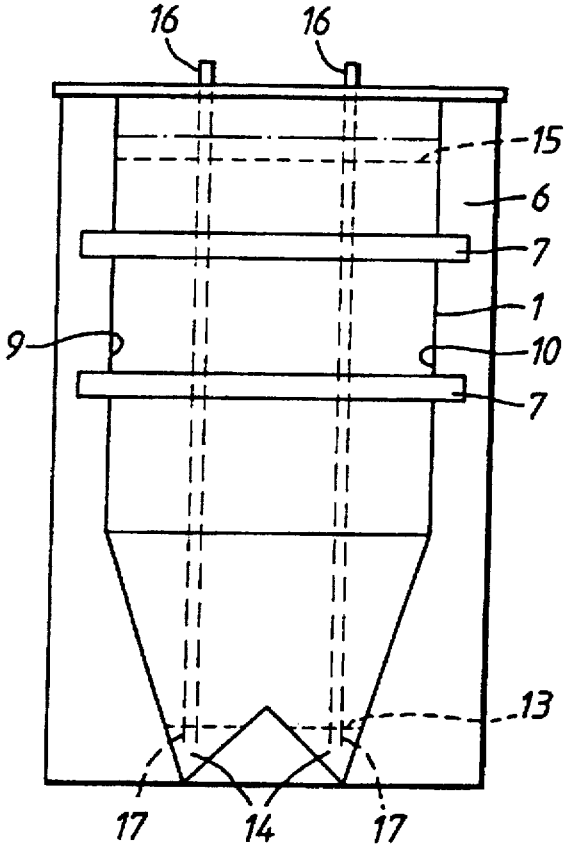
FIG. 3 is a diagrammatic front elevation of the apparatus shown in FIG. 1.

The tipping process is carried out in the apparatus shown in FIGS. 1 to 3 of the drawings. This comprises a vessel or container 1 having a parallelepiped shaped upper portion 2 and a downwardly tapering lower portion 3 in the form of a pair of inverted pyramids which are skewed so that one side face 4 forms a continuation of one side face 5 of the upper portion. The vessel 1 is contained in a water bath 6 by which the contents of the bath can be maintained at a desired temperature and is surrounded by two rings of bracing bars 7.

The vessel 1 contains a partition 8 which lies in a vertical plane parallel to the side faces 4 and 5 of the vessel and makes contact at its side edges 9 and 10 with the adjacent vertical and sloping faces of the vessel. The partition thus divides the vessel into a larger working zone 11 and a smaller return zone 12. At its bottom the partition 8 terminates at horizontal edges 13 above the bottom of the vessel to afford interconnections 14 between the working zone 11 and the return zone 12. At its top, the partition 8 terminates at a horizontal edge 15 below the top edges of the vessel 1.

Two air pipes 16 connected to an air pump (not shown) extend downwardly into the vessel and terminate in open ends near the bottom of the return zone 12 to provide air inlets 17. Mounted above the working zone 11 and not shown in FIGS. 1 to 3 is a fixture 21 to which a jig 51 carrying the blades to be tipped is mounted, the fixture 21 being arranged to position the jig within the vessel in a manner to be described in greater detail below. Conductors, not shown, are provided to apply a voltage to the assembly mounted on the fixture 21 relative to an anode which is suspended in the working zone.

To use the apparatus to codeposit a coating on the blade tips of the blades, a jig is mounted on the fixture 21 which is positioned on the vessel. Before or after the positioning of the fixture, the vessel is filled to a level 18 above the top edge 15 of the partition 8 with a plating solution containing particles to be co-deposited. Air is admitted through the inlets 17 and this rises up in the return zone 12, raising solution and entrained particles. At the top of the return zone, the air escapes and the solution and particles flow over the broad crested weir formed by the top edge 15 of the partition and flow down past the assembly on the fixture 21. At the bottom of the working zone 11, the particles tend to settle and slide down the inclined sides of the vessel towards the interconnections 14 where they are again entrained in the solution and carried round again.

As the downwardly travelling particles in the working zone 11 encounter the tips of the blades at the top of the assembly, they tend to settle on the these tips where they become embedded in the metal which is being simultaneously plated out.

Figure 4:
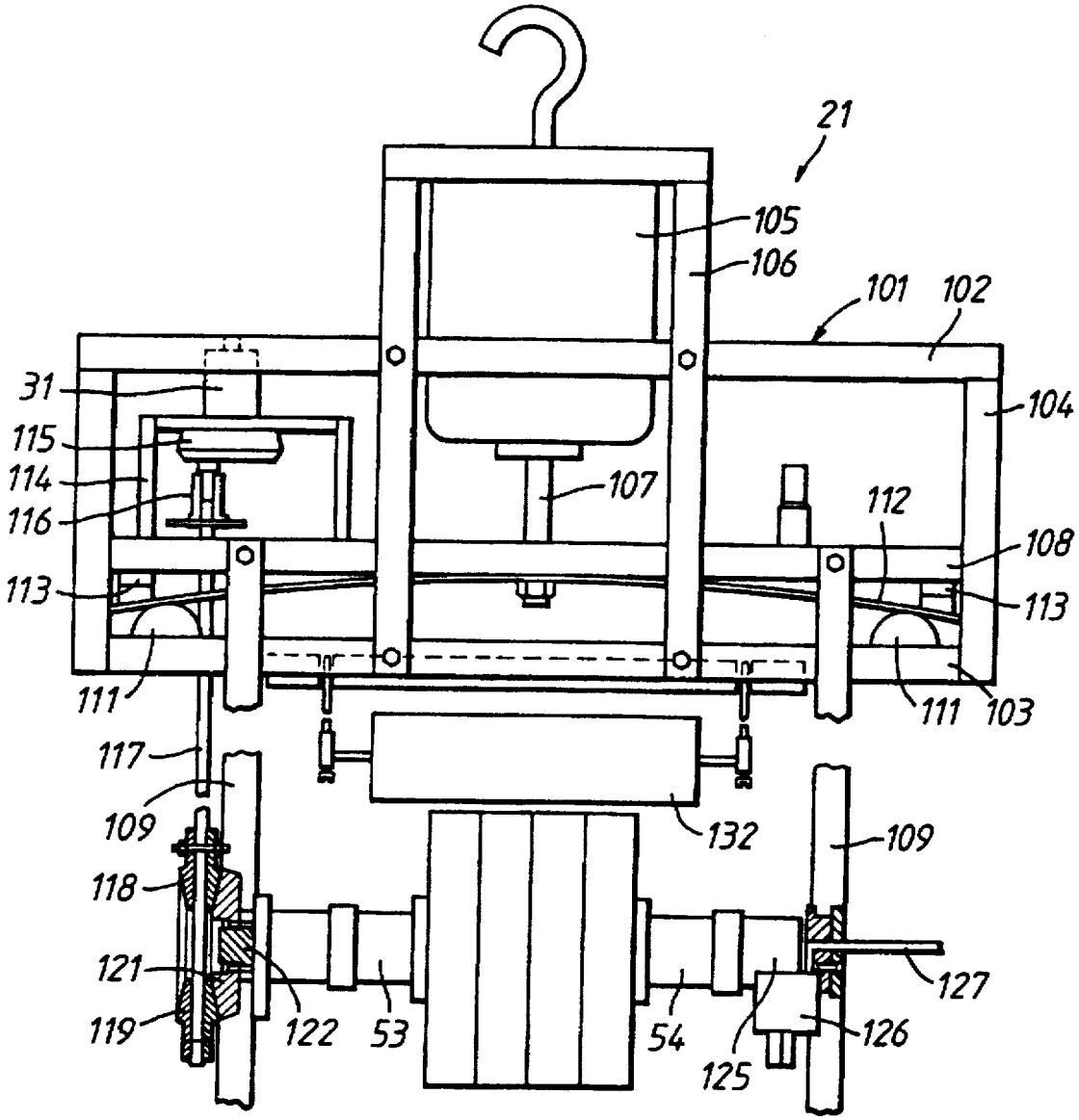
FIG. 4 is a front elevation to a larger scale of a fixture used in the apparatus shown in FIGS. 1 to 3.
Figure 5:
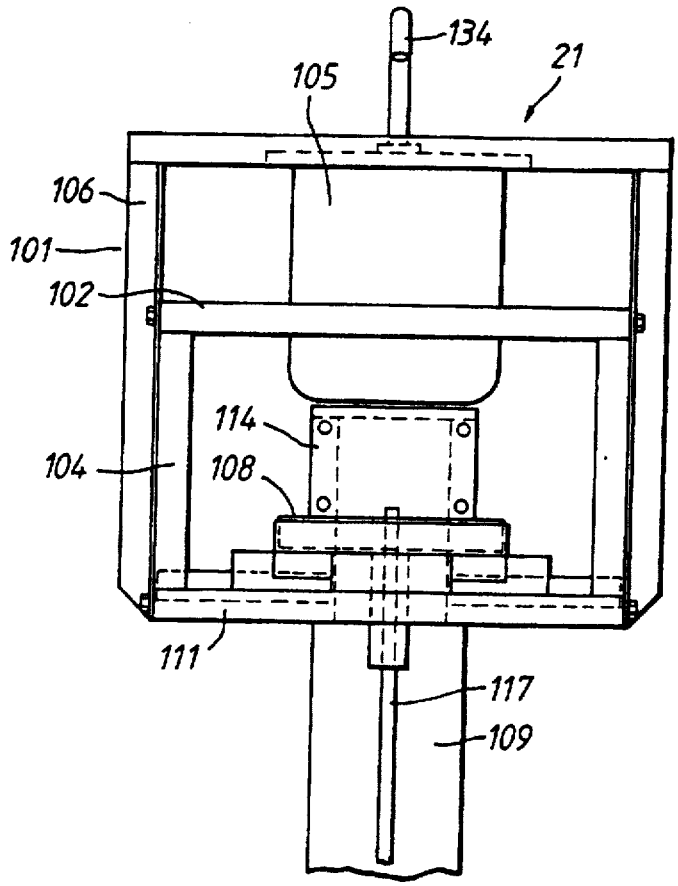
FIG. 5 is an end elevation of the fixture shown in FIG. 4.
Figure 6:
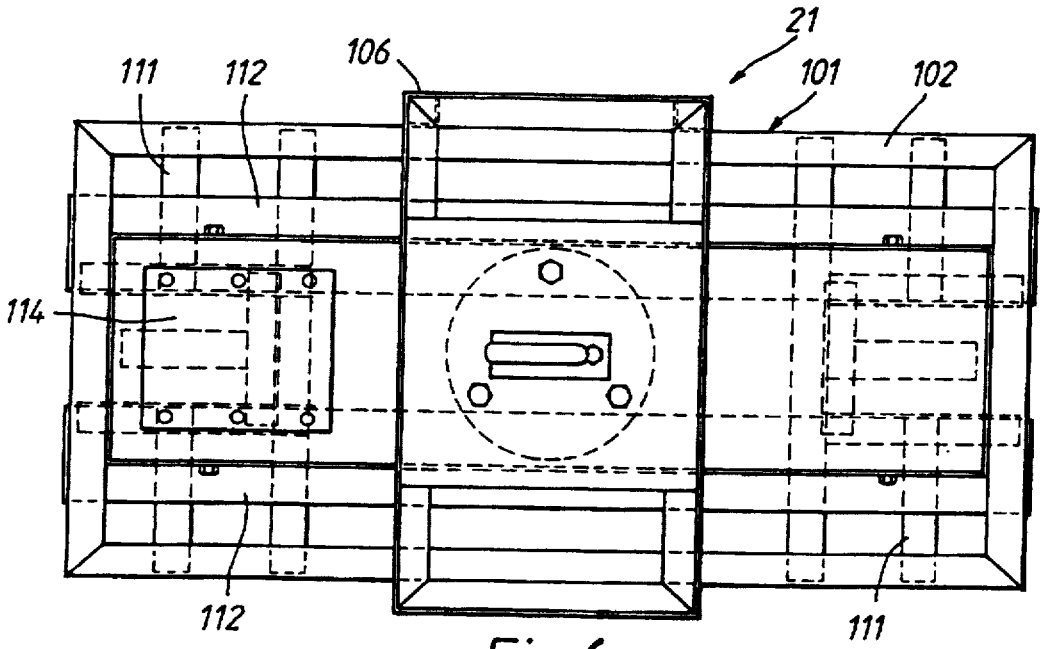
FIG. 6 is a plan view of the fixture shown in FIG. 4.
Figure 7:
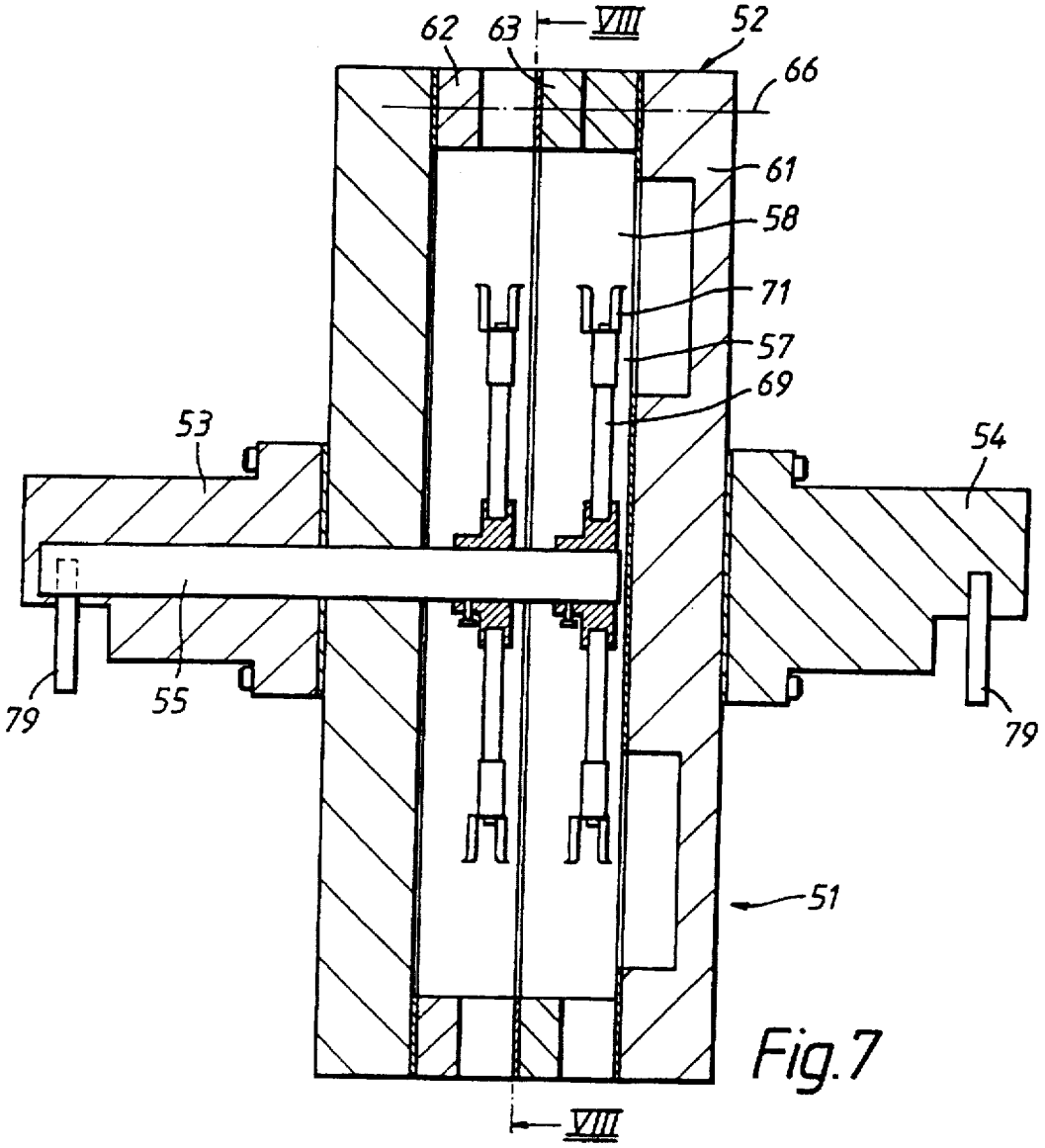
FIG. 7 is an axial section to a larger scale of a jig to hold blades to be tipped, the jig being mountable in the fixture shown in FIGS. 4 to 6.
Figure 10:
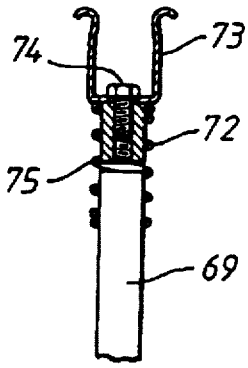
FIG. 10 is a detail to the yet larger scale of a blade holder.
Figure 8:
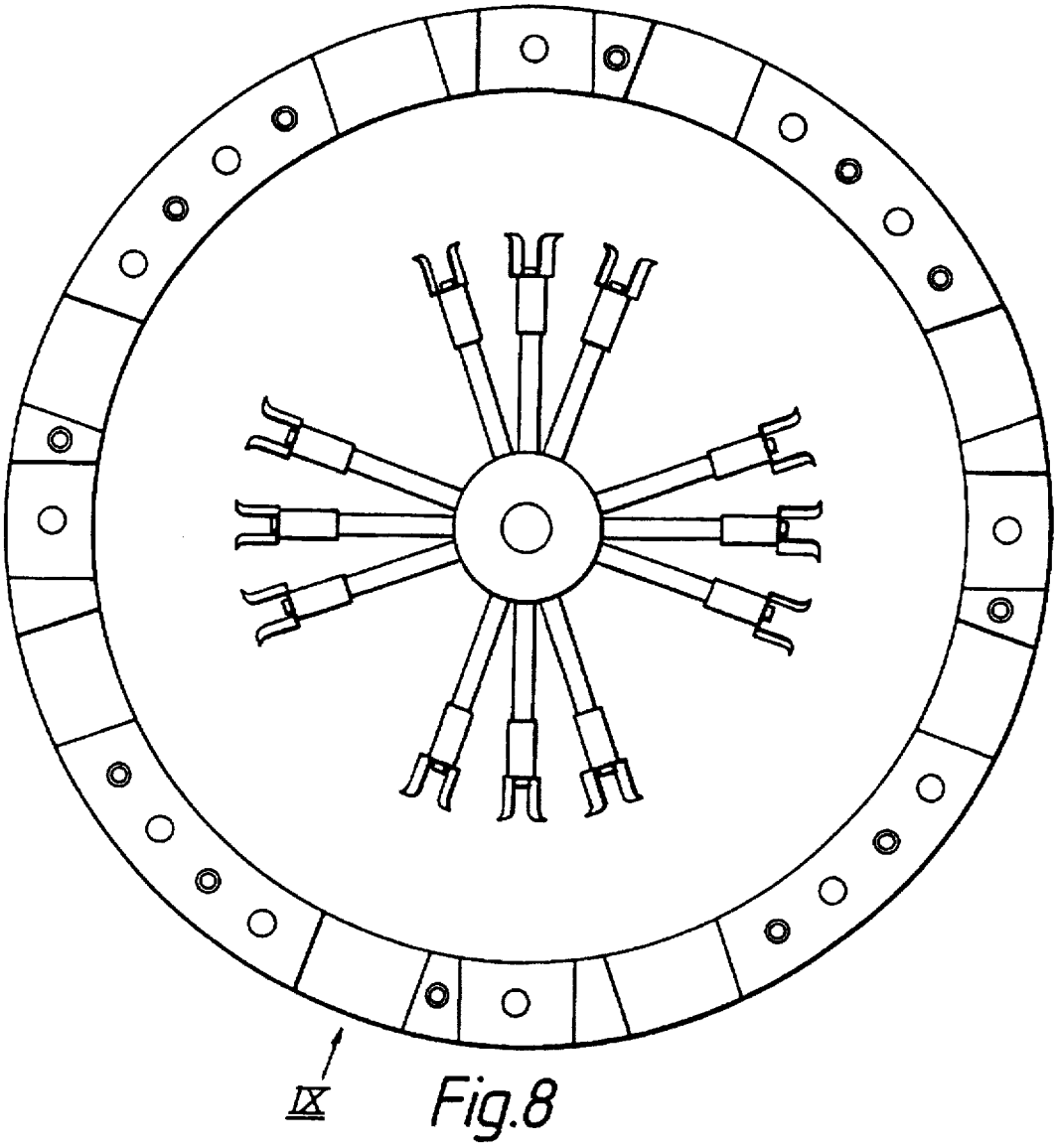
FIG. 8 is a cross-section through the fixture shown in FIG. 7 on the plane VIII—VIII.

The fixture 21 on which the jig 51 carrying the blades to be tipped is shown in detail in FIGS. 4, 5 and 6.

The fixture 21 comprises a space frame 101 comprising an upper rectangular frame 102, a lower rectangular frame 103 and vertical connecting members 104. A vibrator 105 is supported from the frame 101 by a secondary framework 106 and has a downwardly projecting armature 107 engaging a beam 108 of tray-form from which hangers 109 depend, the hangers supporting the jig 51 (shown only schematically in FIG. 4) carrying the blades to be tipped. The fixture 21 can be supported on the upper edges of the vessel 1 by a pair of polypropylene support rods 111 which, when the fixture is in place on the vessel 1, span between the front and back walls of the vessel. The support rods 111 are mounted on the frame 101 for limited vertical movement relative thereto to allow the frame 101 to vibrate relative to the vessel 1. The frame 101 is supported from the support rods 111 by means of a pair of bowed blade springs 112, the lower sides of the outer ends of the springs resting on the support rods 111 and the upper sides of the central parts of the springs engaging the underside of the beam 108. Rubber spring blocks 113 between the outer ends of the springs and the beam maintain the parts in position.

The beam 108 carries near one end a mounting 114 for an electric motor 31 and a gear box 115 joined by a coupling 116 to a vertical shaft 117 carrying at the lower end a first bevel pinion 118 fixed to the shaft and a second freely rotatable balancing bevel pinion 119. The pinions 118,119 engage a bevel crown wheel 121 carried on a stub shaft 122 journalled in one of the hangers 9. The other end of the stub shaft 122 carries connection 53 for one end of the jig 51. A similar connection 53 and stub shaft 125 mounted in the other hanger 9 supports the other end of the jig 51, the connection 54 and stub shaft 125 containing slip-ring means 126 for connecting a line 127 to the jig 51.

The frame 101 also supports further hangers 131 carrying a cylindrical basket 132 containing metal chips and constituting the anode of the plating apparatus. Also, the beam 8 carries an accelerometer 133 to sense the vibrations of the frame 101 to provide a feed-back signal to the central means (not shown) for the vibrator 105. A hook 134 enables the whole fixture 21 and jig 51 carried thereby to be lifted and lowered by a travelling hoist positioned over the vessel 1 and over other similar vessels used for different stages in the blade tipping process.

The fixture 21 is used with a jig 51 which is shown in FIGS. 7 to 10 and in which the blades are mounted. The jig may be briefly described as comprising a cylindrical box 52 having a pair of oppositely directed axially extending connections or stub shafts 53,54, a conductive rod 55 extending through the stub shaft 53 and into the interior of the box 52 and blade supporting units 56,57 mounted on the rod 55 within the box cavity 58. The box 52 comprises two disc-like end pieces 59,61 and two ring members 62,63. Between the stub shafts 53,54 and the adjacent end discs 59,61, between the end discs 59,61 and the adjacent rings 62,63 and between the rings 62,63 there are rubber gaskets. The stub shafts 53,54 are secured to the adjacent discs 59,61 by screws 65 while the end discs and the rings are secured together by through bolts 66. The stub shafts, discs and rings are made of polypropylene.

Each of the blade supporting units 56,57 comprises a boss 67 secured on the rod 55 by a set screw 68, a ring of circumferentially spaced radially extending tubes 69 and blade holders 71. As can be seen from FIG. 10 each blade holder comprises a short tubular portion 72 and a generally U-shaped clip portion 73 secured to the outer end of the tubular portion 72 by means of a screw 74. The tubular portion 72 is axially aligned with the respective tube 69 and the two are joined by a concentric spring 75 which grips both the tubular portion 72 and the tube 69 and provides a flexible coupling between the two to take up any mis-alignment between a blade mounted in the clip portion 73 and the tube 69.

Figure 9:
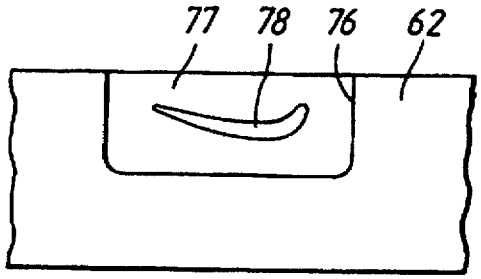
FIG. 9 is scrap elevation to a yet larger scale in the direction of the Arrow IX in FIG. 8.

Each of the rings 62,63 has a circumferential row of generally rectangular notches 76 in one axially facing surface and, as can be seen in FIG. 9 each notch 76 contains a silicone rubber location block 77 having an aperture 78 extending therethrough, the aperture having a blade profile and being of a size to effect a water tight seal with a blade on assembly as will be described.

When the apparatus is to be used for blade tipping the blades are assembled in rings on the blade supporting units, the roots of the blades being held in the spring clips 79. One of the location blocks is pushed over the tip of each of the blades either before or after the blade is positioned on the respective spring clip. The jig is then fully assembled to the condition shown in FIG. 7 with the location blocks positioned in the notches 76 and with the bosses 67 secured to the rod 55 with the set screws 68. The box 52 is then clamped up tight by means of the through bolts 66. In this condition the box cavity 58 and the parts of the blades in-board of the location blocks 77 are completely sealed from the exterior. The completely assembled jig is then mounted on the fixture 21 with the outer ends of the stub shafts 53,54 being received in the journals 25, radially projecting studs 79 being received in corresponding recesses (not shown) in the journals 25 to ensure that the motor 31 will drive the assembly 52. The rod 55 and the respective stud 79 provides an electrical path through leads not shown to the blades for electroplating purposes.

The use of apparatus of the construction described to produce abrasive tips on the gas turbine blades will now be described.

The jig 51 is degreased in a vapour degreaser or a proprietary degreasing agent such as GENKLENE (Registered Trade Mark). The blade tips are then given an anodic clean for five minutes at 6 to 8 volts in a cleaning solution consisting of sodium hydroxide/gluconate/thiocyanate and then rinsed thoroughly in cold running water. The exposed tips of the blades are then etched by submerging the jig in a solution comprising approximately 300 gms/1 ferric chloride, 58 gms/1 hydrochloric acid and 1% hydrofluoric acid (60% w/w) for five minutes at room temperature and again rinsed thoroughly in cold running water. The jig is then placed in a nickel chloride bath to provide a strike which is given at 3.87 amps per square decimeter (36 amps per quare foot) for four minutes. The strike bath comprises approximately 350 gms/1 nickel chloride and 33 gms/1 hydrochloric acid.

The jig 51 is then placed in the fixture 21 shown in FIG. 4 and the assembly comprising the fixture 21 and the jig 51 is placed in the apparatus shown in FIGS. 1 to 3. The bath contains a cobalt plating solution with 20 to 30 weight percent particles of CrAlY containing 67–68 parts by weight Cr, 29–31 parts by weight Al and 1.5 to 2.4 parts by weight Y with a size distribution both in the bath and in the as-deposited coating as given in the following table, the columns relating to the size band being the upper and lower limits of the cut measured in micrometers.

TABLE

| Size Band | | Percent |
|---|---|---|
| 118.4 | 54.9 | 0 |
| 54.9 | 33.7 | 0 |
| 33.7 | 23.7 | 0.3 |
| 23.7 | 17.7 | 1.3 |
| 17.7 | 13.6 | 4.3 |
| 13.6 | 10.5 | 17.7 |
| 10.5 | 8.2 | 38.1 |
| 8.2 | 6.4 | 18.3 |
| 6.4 | 5.0 | 12.3 |
| 5.0 | 3.9 | 8.2 |
| 3.9 | 3.0 | 0.1 |
| 3.0 | 2.4 | 0 |
| 2.4 | 1.9 | |

Plating is continued for a period of 4 hours at a current density of 0.075 amps per decimeter (10 amps per square foot) with the controller set to rotate the motor at such a speed as to rotate the assembly at 0.33 revolutions per minute. Air is admitted continuously to maintain circulation of the solution and suspended CrAlY particles. This plating provides a binding coat of CoCrAlY on the tips of the blades to a thickness of between 25 and 50 μm. Deposition of CoCrAlY from the bath described will produce a layer having a composition which is approximately in weight percent: Al 10, Cr32, Y 0.5 and the balance Co.

The assembly is then raised from the bath and the jig is rinsed over the tank with demineralised water and then removed from the region of the tank and rinsed in running water. The jig is then placed in a Woods nickel bath or 1 volume percent sulphuric acid bath to reactivate the surfaces and the assembly is then placed in a second bath similar to the first bath except that in place of the CrAlY particles it contains particles of cubic boron nitride of 100/220 mesh i.e. approximately 125–150 μm. Initially, no air is admitted through the inlet and plating is commenced at 2.7 amps per decimeter (25 amps per square foot) and then air is switched on for a period of 5 seconds. The boron nitride particles go into circulation and Cascade over the assembly. Plating is then continued without the admissions of air for a period of approximately 40 minutes to secure the particles resting on the blade tips to the tips. It may be found that in some cases it is beneficial to have a further burst of 5 seconds of air after 20 minutes to ensure a uniform and maximum distribution of CBN particles over the blade tip surfaces.

The assembly is now removed from the CBN bath, the jig is rinsed over the tank and is then rinsed in a static bath and finally rinsed thoroughly in running water. The surfaces being coated are then reactivated in a Woods nickel or 1% sulphuric acid bath and the assembly is replaced in the CoCrAlY bath. The motor is activated to rotate the jig at 0.33 rpm and plating is continued for 7 hours at 1.075 amps per decimeter (10 amps per square foot) with continuous admission of air to maintain circulation of the solution and suspended CrAlY particles. This fills the spaces under and around the CBN particles with CoCrAly to a depth which leaves the tips of the abrasive particles slightly proud of the surrounding CoCrAly.

During the infilling process to provide a matrix around the particles, the jig may be rotated with a start-stop action. Thus the motor is controlled to produce a rotation of the jig unidirectionally and at a speed of one rotation in 3 minutes with the rotation being intermittent with 10 second stop periods being interspersed with three second go periods. Optionally in addition the vibrator may be used. The vibrator is arranged to give a vibration at a frequency of 50 Hz with alternating periods of high intensity and low intensity vibration, the high intensity periods having a duration of 5 seconds and a peak acceleration of 10 g and the low intensity periods having a duration of 75 seconds with a peak acceleration of 2 g. The vibration and the rotation produce homogeneous infill and ensure that the CrAlY particles reach the areas shadowed by the CBN particles.

At the end of the infill stage the assembly is removed and the jig is rinsed over the tank with demineralised water and then rinsed thoroughly in running water. After inspection the assembly is then heat treated from between ½ and 1 hour at 1090 plus or minus 10° C. in vacuum or in 50–100 millibar partial pressure argon and fast gas quenched. The blades may then be aluminized by one of the well-known processes such as pack aluminizing.

Figure 12:
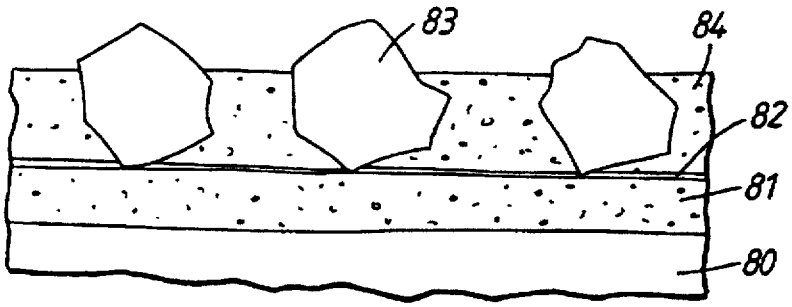
FIG. 12 is an enlarged section through part of the tip region of a blade having an abrasive tip produced in the manner to be described.

One of the tips produced in the manner described is shown in section in FIG. 12 and can be seen to comprise the body 80 of the blade, a binding coat 81 of MCrAlY of a thickness, in this example, of 25–50 μm, an anchoring coat 82 of MCrAlY of a thickness of 10–20μm in which is anchored the bottom portions of the abrasive particles 83 of cubic boron nitride with a particle size of 125–150 μm, and an infill 84 of MCrAlY with a thickness of 70–110 μm.

Instead of particles of pure cubic boron nitride it would be possible to use particles of this or another abrasive which are coated with a material which will protect them, for a time at least, from severe oxidation. For example, it would be possible to use cubic boron nitride particles which had been given a substantially air-impermeable coating of aluminium oxide or an intermetallic such as nickel aluminide.

Figure 11:
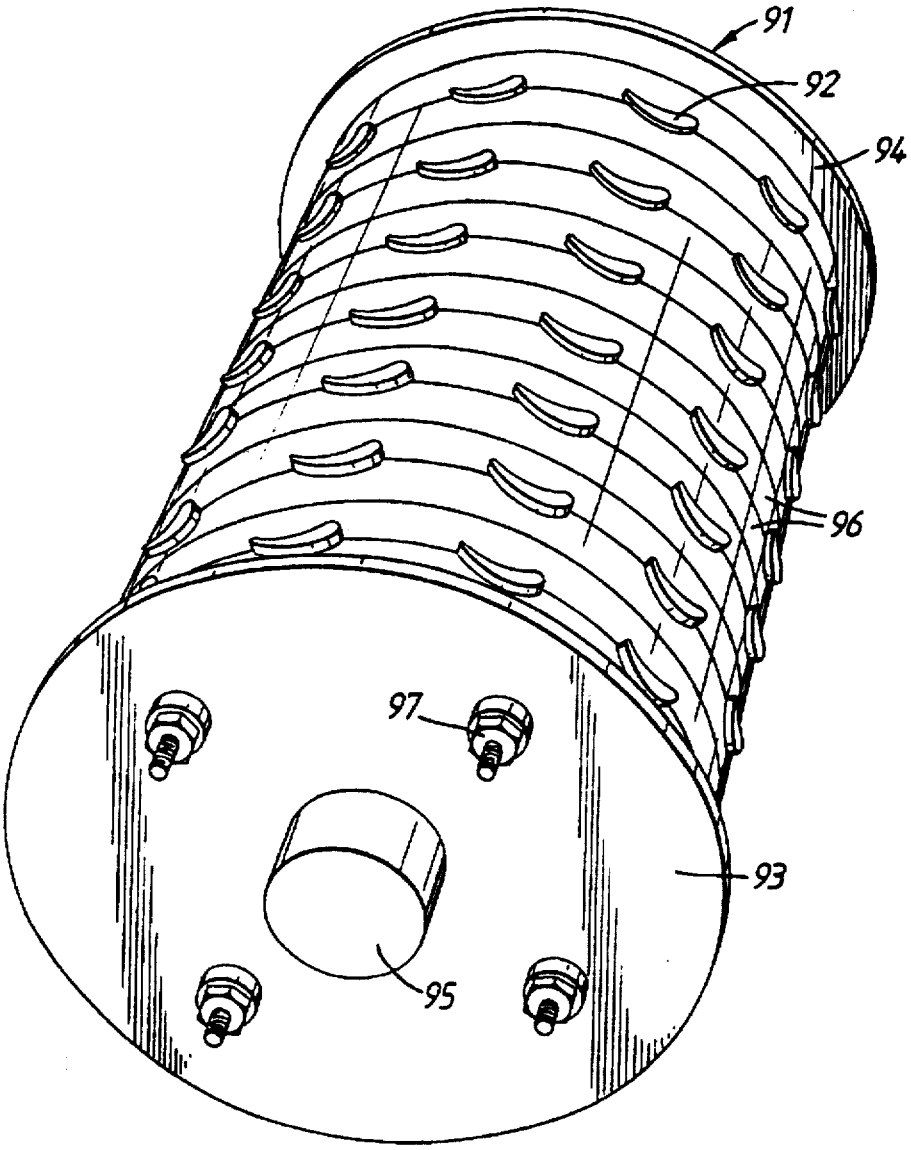
FIG. 11 is a perspective view of another jig on which blades are mounted and which is mountable in the fixture shown in FIGS. 4 to 6.

In the modification shown in FIG. 11 the jig 91 carries seven rows of blades 92 instead of only two as shown in the preceding Figures. The jig comprises two end discs 93,94 carrying stub shafts 95 and seven pairs of intermediate discs 96, the hole assembly being held together by through bolts 97. The parting lines between adjacent intermediate rings of each pair extend through the planes of the rows and apertures for the blades are formed partly in one and partly in the other of each so that the profile of each blade is partially located in one ring and partially located in the other ring of a pair.

While in the apparatus described the blades have been carried by the spring clips 71 it would be possible for them to be supported by means similar to those by which they will be supported in their operating positions; thus for example with blades with fir tree roots the blade support assembly could be provided with complementary fir tree grooves to receive them. In particular, it would be possible for the blades to be assembled on a compressor or rotor disc and for the rotor disc to be mounted in the jig cavity 58 in place of the blade supporting units 56,57.

We claim:

1. A jig for use in the production by electrodeposition of abrasive tips on compressor or turbine rotor blades comprising a hollow, generally cylindrical housing having two end discs and at least one ring therebetween, the discs and the ring defining an interior to receive the majority of each blade, the ring having respective apertures for outer portions of aerofoil parts of the blades to project therethrough, sealing means for sealing the blades as they pass through the respective apertures, and means for securing the discs and the ring together.

2. The jig of claim 1 in which the respective apertures are arranged in at least one circumfertial row.

3. The jig of claim 1 in which the sealing means comprises, for each aperture, a block of resilient material having a blade aperture which is adapted to be a close fit around such blade and which is a close fit in the respective aperture in the ring.

4. The jig of claim 3 in which the respective apertures are notches which are arranged in at least one circumfertial row.

5. The jig of claim 4 in which there are at least two rings disposed between the end discs.

6. The jig of claim 5 further including at least one blade supporting unit mounted on an axial support and having carrying means for receiving roots of the blades.

* * * * *